US006585253B1

(12) United States Patent
Miki

(10) Patent No.: US 6,585,253 B1
(45) Date of Patent: Jul. 1, 2003

(54) FEEDER WITH VIBRATING SEPARATING DEVICE

(75) Inventor: Katsuhiko Miki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 85 days.

(21) Appl. No.: 09/672,851

(22) Filed: Sep. 29, 2000

(30) Foreign Application Priority Data

Sep. 30, 1999 (JP) ..... 11-280031
Mar. 17, 2000 (JP) ..... 2000-076756
Sep. 7, 2000 (JP) ..... 2000-271425

(51) Int. Cl.[7] ..... B65H 3/52

(52) U.S. Cl. ..... 271/125; 271/124; 271/121; 271/42; 271/267; 318/460

(58) Field of Search ..... 271/121, 122, 271/123, 124, 125, 126, 42, 267; 318/460

(56) References Cited

U.S. PATENT DOCUMENTS 4,484,737 A * 11/1984 Sugiyama ..... 271/264
4,647,183 A * 3/1987 Hohjoh ..... 271/267
4,674,736 A * 6/1987 Tsubo ..... 271/122
4,762,314 A * 8/1988 Harada ..... 271/151
4,844,638 A * 7/1989 Kagami et al. ..... 271/116
4,955,598 A * 9/1990 Hiroshige et al. ..... 198/769
4,997,177 A * 3/1991 Mori et al. ..... 271/267
5,062,622 A * 11/1991 Kataoka et al. ..... 271/267
5,071,113 A * 12/1991 Nakamura et al. ..... 198/736
5,149,080 A * 9/1992 Yamamoto ..... 271/193
5,249,795 A * 10/1993 Nishimoto ..... 271/265.02
5,451,043 A * 9/1995 Arai ..... 271/121

FOREIGN PATENT DOCUMENTS

JP 60244735 * 12/1985
JP 1274674 * 11/1989
JP 2059749 * 2/1990
JP 05213468 8/1993
JP 05330683 12/1993

* cited by examiner

*Primary Examiner*—Patrick H. Mackey
(74) *Attorney, Agent, or Firm*—Oblon, Spivak, McClelland, Maier & Neustadt, P.C.

(57) ABSTRACT

A paper feeder for use in an image forming apparatus is disclosed. The paper feeder applies vibration to paper sheets being paid out together to thereby reduce an adhering force acting between them. The paper feeder therefore reduces the simultaneous feed of two or more papers to a noticeable degree. An image forming apparatus including the paper feeder is also disclosed.

62 Claims, 7 Drawing Sheets

FEEDER WITH VIBRATING SEPARATING DEVICE

BACKGROUND OF THE INVENTION

The present invention relates to a copier, printer, facsimile apparatus or similar image forming apparatus and more particularly to a paper feeder for use in an image forming apparatus.

A paper feeder for use in an image forming apparatus generally includes a feed roller and a separating member that nip paper sheets being paid out together there between so as to separates them. Conventional paper separation systems are generally classified into two types, i.e., a roller type system and a friction pad type system. The roller type system includes a feed roller rotatable in a direction of a paper feed and a reverse roller pressed against the feed roller. A drive mechanism causes the reverse roller to rotate via a torque limiter in a direction opposite to the above direction. So long a single paper sheet is paid out to a nip between the feed roller and the reverse roller, the reverse roller follows the rotation of the feed roller via the torque limiter. When two or more paper sheets arrive at the nip together, the reverse roller rotates in the direction opposite to the direction of paper feed to thereby separate the paper sheets from each other. The friction pad type system includes a friction pad in place of the reverse roller as well as the feed roller. The friction pad is pressed against the feed roller in order to separate paper sheets being conveyed together by the feed roller.

Assume that paper sheets closely adhere to each other due to static electricity or irregular cut edges thereof, or that coated paper sheets or similar highly smooth paper sheets closely adhere to each other due to vacuum or high humidity. Then, the coefficient of friction between the paper sheets is apt to exceed the coefficient of friction between the feed roller and the reverse roller or the friction pad. In this condition, the conventional separation systems are apt to fail to surely separate paper sheets being paid out together.

To solve the above problem, Japanese Patent Laid-Open Publication No. 6-100179, for example, proposes a paper feeder that applies vibration to paper sheet stacked on a tray in order to loosen the paper sheets. However, causing a stack of paper sheets to vibrate is not practicable without resorting to vibration and force, which are extremely intense, and therefore without resorting to an expensive mechanism.

Japanese Patent Laid-Open Publication No. 5-201571 teaches a paper feeder including a feed roller fixed in place and a piece of separating sheet movable back and forth in a direction of paper feed in a vibrating fashion, thereby enhancing the separation of paper sheets. However, the vibration of the separating member moving back and force in the above direction is scarcely transferred to paper sheets and cannot loosen the paper sheets. The separating ability achievable with the separating member is only of the same degree as one achievable with the reverse roller.

Further, Japanese Patent Laid-Open Publication No. 5-213468 discloses a paper feeder including a feed roller fixed in place and a separating member vibratable up and down in order to delicately vary a force acting against paper conveyance. Such a separating member can be implemented as a pad having a great coefficient of friction and allows the separating ability to vary in matching relation to paper sheets on the basis of control over vibration. This kind of scheme is effective when the pad pressure is suppressed in order to vary the separating condition. However, the vibration is applied to paper sheets before separation and therefore cannot sufficiently loosen the paper sheets.

Technologies relating to the present invention are also disclosed in, e.g., Japanese Patent Laid-Open Publication No. 5-330683.

SUMMARY OF THE INVENTION

It is therefore an object of the present invention to provide a paper feeder capable of applying vibration to paper sheets being paid out together to thereby reduce an adhering force acting between the paper sheets and prevent them from being fed together, and an image forming apparatus including the same.

In accordance with the present invention, a paper feeder for separating paper sheets from each other while conveying the paper sheets includes a feed roller configured to rotate by being driven. A separating member is pressed against the feed roller. The paper sheets are nipped between the feed roller and the separating member. A vibration generating device applies vibrations, which are synchronous to each other, to the feed roller and separating member.

Also, in accordance with the present invention, an image forming apparatus includes a paper feeder including a feed roller driven to rotate and a separating member pressed against the feed roller for conveying paper sheets nipped between the feed roller and the separating member while separating them from each other. A vibration generating device applies vibrations, which are synchronous to each other, to the feed roller and separating member.

Further, in accordance with the present invention, a paper feeder for separating paper sheets from each other while conveying the paper sheets includes a feed roller driven to rotate and a separating member pressed against the feed roller. The paper sheets are nipped between the feed roller and the separating member. A vibration generating device applies vibration to the feed roller. The feed roller causes the separating member to vibrate when caused to vibrate by the vibration generating device.

Moreover, in accordance with the present invention, an image forming apparatus includes a paper feeder including a feed roller driven to rotate and a separating member pressed against the feed roller for separating paper sheets from each other while conveying them. The paper sheets are nipped between the feed roller and the separating member. A vibration generating device applies vibration to the feed roller. The feed roller causes the separating member to vibrate when caused to vibrate by the vibration generating device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
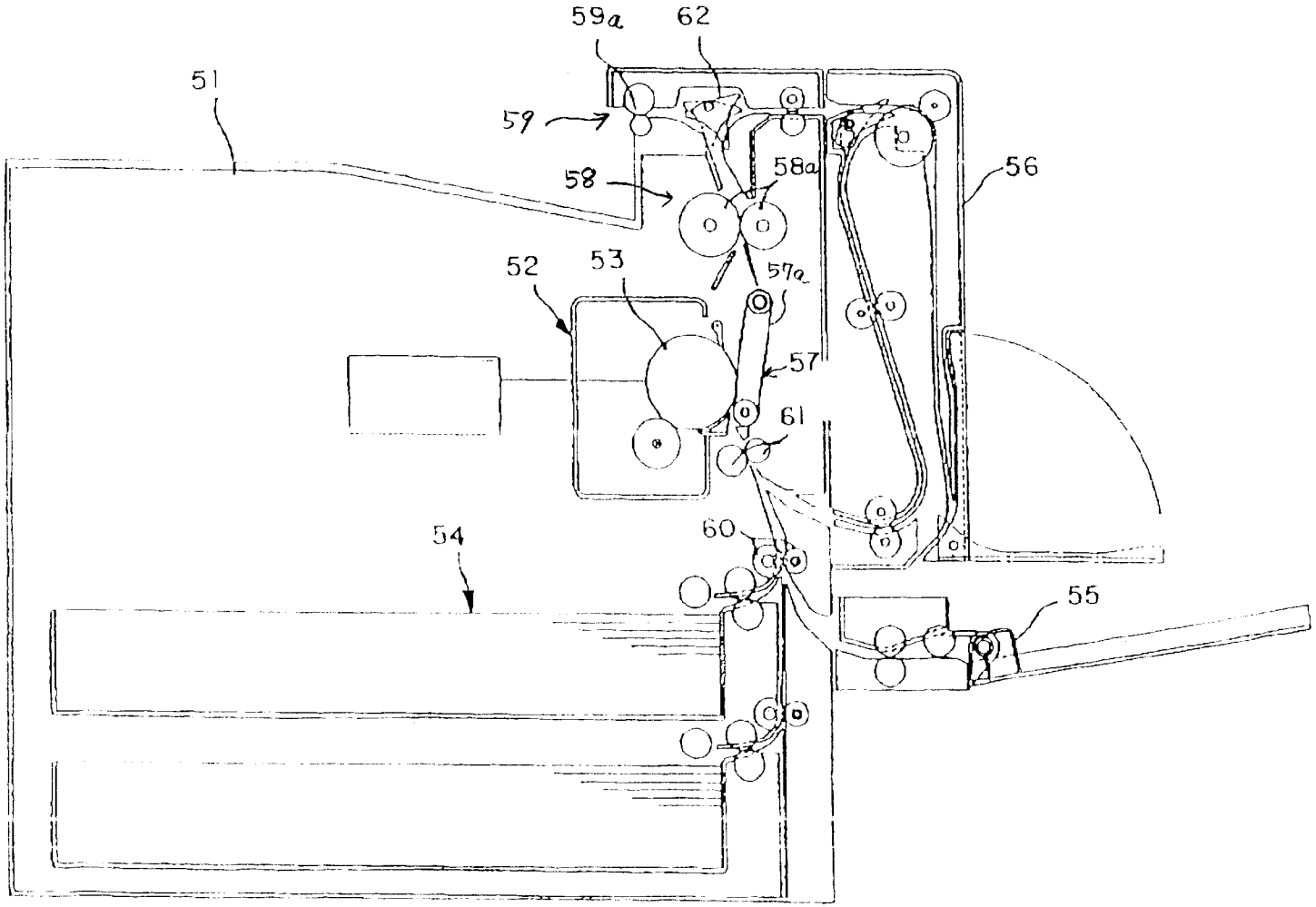
FIG. 1 is a view showing an image forming apparatus embodying the present invention.

Referring to FIG. 1 of the drawings, an image forming apparatus embodying the present invention is shown and includes an apparatus body or casing 51. An image forming section 52 is disposed in the apparatus body 51 for executing a conventional electrophotographic image forming process. The image forming section 52 includes a photoconductive drum or image carrier 53 and a charger, a developing device and so forth that are not shown. A paper feeder 54 in accordance with the present invention is arranged below the image forming section 52 and includes two trays positioned one above the other. A manual paper feeder 55 and a paper turning unit, which is available for a duplex copy mode, are mounted on the apparatus body 51.

A roller pair 60 conveys a paper sheet fed from the paper feeder 54 or the manual paper feeder 55 to a registration roller pair 61. The registration roller pair 61 drives the paper sheet toward an image transferring unit 57 such that the leading edge of the paper sheet meets the leading edge of a toner image formed on the drum 53. The image transferring unit 57 includes a transfer belt 57. While the transfer belt 57 in movement conveys the paper sheet upward, the toner image is transferred from the drum 53 to the paper sheet. As the transfer belt 57 further conveys the paper sheet upward, a fixing roller pair 58*a,* which constitute a fixing unit 58, cooperate to fix the toner image on the paper sheet with heat and pressure. A path selector 62 is positioned above the fixing unit 58 for steering the paper sheet carrying the fixed toner image thereon toward a paper outlet 59 or the paper turning unit 56. Specifically, the path selector 62 steers the paper sheet toward the paper outlet 59 when switched to a position indicated by a solid line or steers it toward the paper turning unit 56 when switched to a position indicated by a dash-and-dot line.

Figure 2:
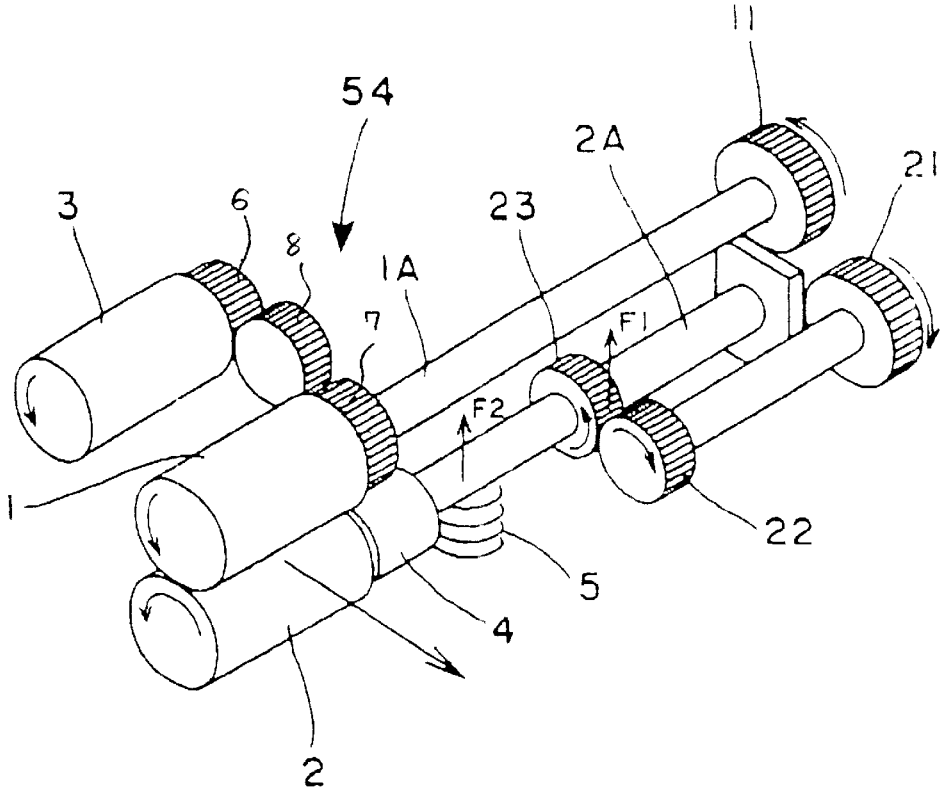
FIG. 2 is a fragmentary isometric view showing a paper feeder included in the illustrative embodiment.

FIG. 2 shows a specific configuration of the paper feeder 54. As shown, the paper feeder 54 includes a feed roller 1 and a reverse roller or separating member 2 pressed against the feed roller 1. The paper feeder 54 therefore uses the previously mentioned roller type system as distinguished from the friction pad type system. A gear 11 is mounted on the feed roller 1 and connected to a driveline not shown. The gear 11 causes the feed roller to rotate in a direction of paper feed, as indicated by an arrow in FIG. 2. On the other hand, a gear 21 is connected to a driveline, not shown, and causes a drive gear 22 to rotate. The drive gear 22, in turn, drives a driven gear 23 mounted on a reverse roller shaft 2A on which the reverse roller 2 is mounted. The gear 21 therefore causes the reverse roller 2 to rotate in a direction of paper return opposite to the direction of paper feed, as indicated by an arrow in FIG. 2.

A torque limiter 4 applies a preselected torque to the reverse roller 2 in the direction opposite to the direction of paper feed. A tooth surface pressure F1 between the drive gear 22 and the driven gear 23 and the initial pressure 22 of a spring or biasing means 5 press the reverse roller 2 against the feed roller 1 in combination. A pickup roller 3 is mounted on a shaft on which a gear 6 is mounted. The gear 6 is connected to a gear 7, which is mounted on a feed roller shaft 1A, via an idle gear 8, causing the pickup roller 3 to rotate in the same direction as the feed roller 1, as indicated by an arrow in FIG. 2.

Figure 3:
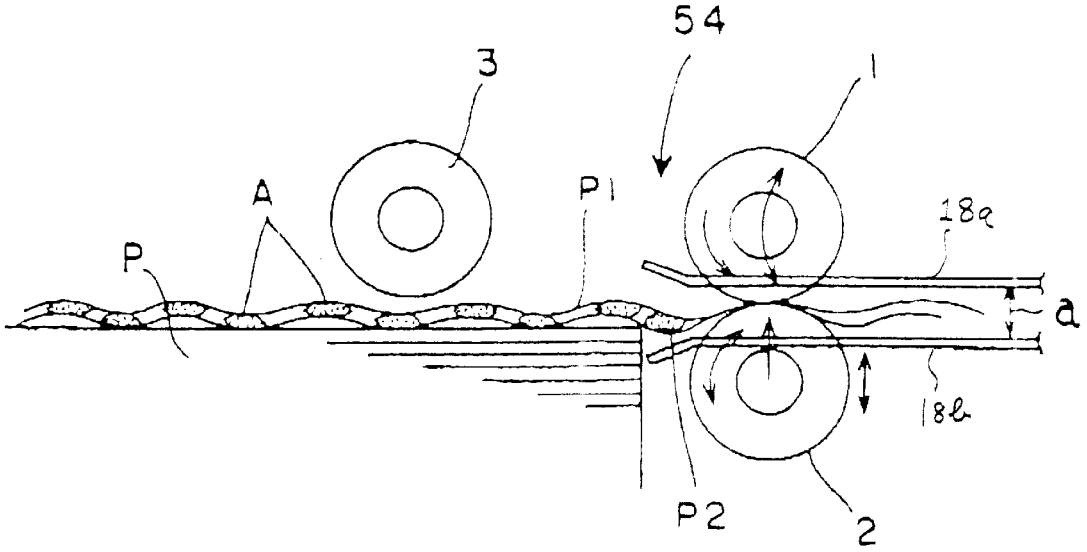
FIG. 3 is a view showing how the paper feeder of FIG. 2 loosens paper sheets being paid out together.

As shown in FIG. 3 specifically, the pickup roller 3 pays out a paper sheet from the top of a paper stack P loaded on the paper feeder 54. At this time, it is likely that two or more paper sheets are paid out together and brought to a nip between the feed roller 1 and the reverse roller 2. The reverse roller 2, rotating in the direction of paper return due to the previously mentioned torque, returns the paper sheet underlying the top paper sheet and contacting the reverse roller 2. As a result, the top paper sheet is successfully separated from the underlying paper sheet or sheets. However, when an adhering force acting between the paper sheets is greater than the returning force available with the reverse roller 2, the reverse roller 2 is apt to fail to return the underlying paper sheet.

To achieve a higher separating ability, the paper feeder 54 is constructed to apply, when the adhering force acting between the paper sheets is intense, vibration to the paper sheets for thereby surely feeding the paper sheets one by one.

Figure 4:
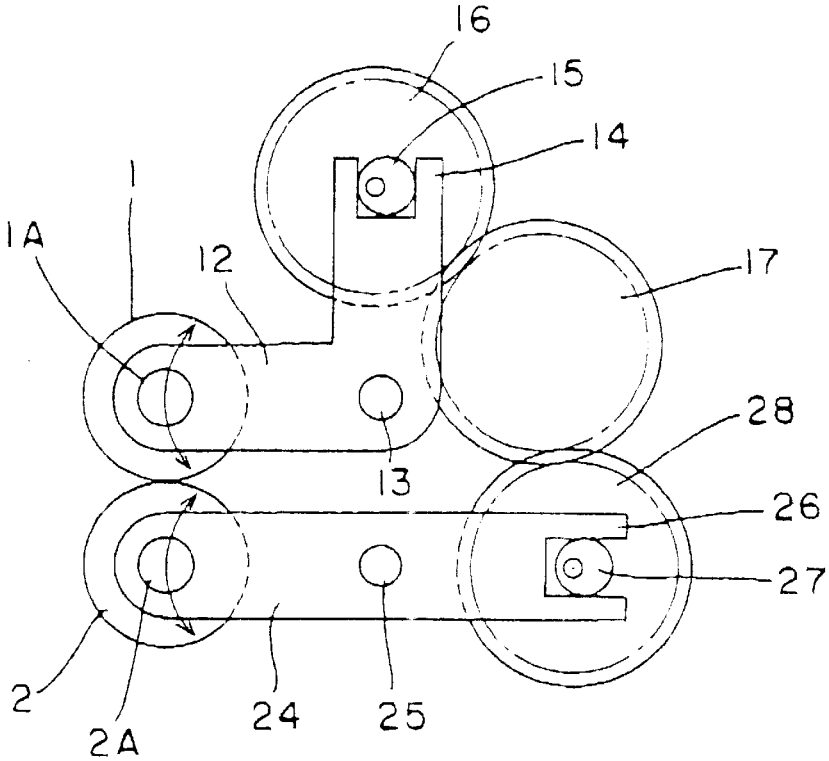
FIG. 4 is a view showing a specific configuration of a vibration generating device included in the illustrative embodiment for causing a feed roller and a reverse roller to vibrate in synchronism with each other at the same period.

FIG. 4 shows a specific configuration of a vibration generating device that applies vibrations to the feed roller 1 and reverse roller 2; the vibrations occur in synchronism to each other at the same period. As shown, the vibration generating device includes a generally L-shaped arm or support member 12 angularly movable about a shaft 13. The feed roller 1 is rotatably supported by one end of the arm 12. The other end of the arm 12 is configured as an engaging portion 14 in which an eccentric cam 15 is received. A drive gear 16 is mounted on the same shaft as the eccentric cam 15. A straight arm or another support member 24 is angularly movable about a shaft 25. The reverse roller 2 is rotatably supported by one end of the arm 24. The other end of the arm 24 is configured as an engaging portion 27 in which an eccentric cam 27 identical in shape with the eccentric cam 15 is received. A driven gear 28 is mounted on the same shaft as the eccentric cam 27. In the illustrative embodiment, the diameter of the feed roller 1 and that of the reverse roller 2 may not be the same, but the distance between the shaft 13 and the feed roller 1 and the distance between the shaft 25 and the reverse roller 2 should be identical.

The drive gear 16 and driven gear 28 are identical in diameter and tooth shape and connected to each other via an idler gear 17. When the drive gear 16 is caused to rotate, the idler gear 17 meshing with the drive gear 16 causes the driven gear 28 to rotate at the same speed as the drive gear 16. In this configuration, the eccentric cams 15 and 27 respectively cause the feed roller 1 and reverse roller 2 to vibrate with the same amplitude at the same period. This is because the distance between the shaft 13 and the feed roller 1 and the distance between the shaft 25 and the reverse roller 2 are identical and because the eccentric cams 15 and 17 are identical in shape.

As shown in FIG. 3, assume that the top paper sheet P1 and the paper sheet P2 underlying it are paid out together and nipped between the feed roller 1 and the reverse roller 2. Then, the feed roller 1 and reverse roller 2 in vibration cooperate to loosen the paper sheets P1 and P2 and thereby introduce air between the paper sheets P1 and P2 in the form of layers A. The air layers A cancel the adhesion acting between the paper sheets P1 and P2. Consequently, the reverse roller 2 rotating in the direction of paper return separates the paper sheet P2 from the paper P1 with the original coefficient of friction acting between the paper sheets P1 and P2. This is successful to feed the paper sheets one by one without regard to the degree of adhesion between the paper sheets. In addition, because the feed roller 1 and reverse roller 2 vibrate in synchronism with each other, the amplitude of vibration can be increased in order to further promote sure loosening of the paper sheets.

Figure 5:
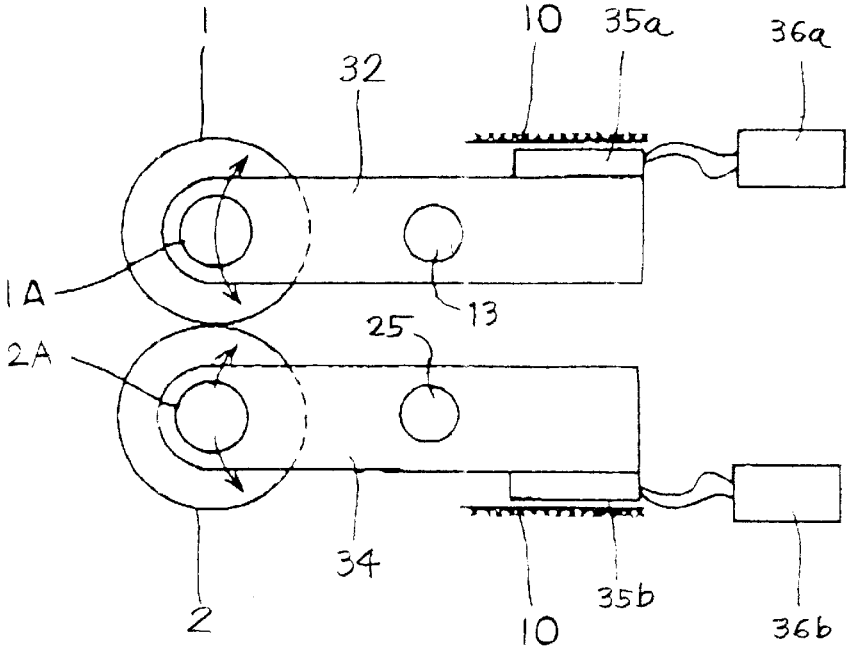
FIG. 5 is a view showing another specific configuration of the vibration generating device.
Figure 6:
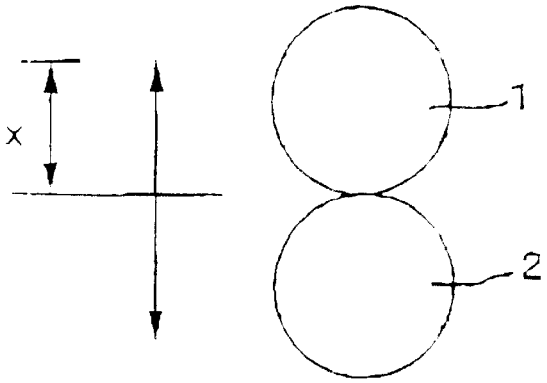
FIG. 6 is a view for describing the amplitude of vibration of the feed roller and that of the reverse roller.

Another specific configuration of the vibration generating device will be described with reference to FIG. 5. As shown, the feed roller 1 and reverse roller 2 are supported by straight arms 32 and 34, respectively. The arms 32 and 34 are angularly rotatable about the shafts 13 and 25, respectively. Piezoelectric devices 35*a* and 35*b* are respectively mounted on the arms 32 and 34 in order to cause the feed roller 1 and reverse roller 2 to vibrate. Variable voltage sources 36*a* and 36*b* are connected to the piezoelectric devices 35*a* and 35*b*, respectively. The piezoelectric devices 35*a* and 35*b* each generate a stress proportional to a voltage applied thereto. The variable voltage sources 36*a* and 36*b* respectively vary voltages applied to the piezoelectric devices 35*a* and 35*b* in any desired manner, so that the feed roller 1 and reverse roller 2 can vibrate. Again, the distance between the shaft 13 and the feed roller 1 and the distance between the shaft 25 and the reverse roller 2 are identical. The piezoelectric devices 35*a* and 35*b* have the same performance as each other. In FIG. 5, the reference numeral 10 designates frames.

The vibration generating device having the above configuration can also cause the feed roller 1 and reverse roller 2 to vibration with the same amplitude at the same period as each other. This also allows the amplitude of vibration to be increased for further promoting sure loosening of the paper sheets.

As shown in FIG. 3, the illustrative embodiment additionally includes an upper guide 18*a* and a lower guide 18*b* that form a paper conveyance path. The two guides 18*a* and 18*b* are located in the range where the feed roller 1 and reverse roller 2 are pressed against each other. As shown in FIG. 3, assume that the feed roller 1 vibrates over a width x. Then, the width of the paper conveyance path, i.e., the distance a between the guides 18*a* and 18*b* is so selected as to satisfy a relation:

$$a \geqq 2 \times x$$

In this case, by adjusting the eccentricity of the eccentric cam 15, the length of the arm 12 or the position of the shaft 13, it is possible to suitably adjust the vibration width of the feed roller 1 within a range smaller than the distance a.

Figure 7:
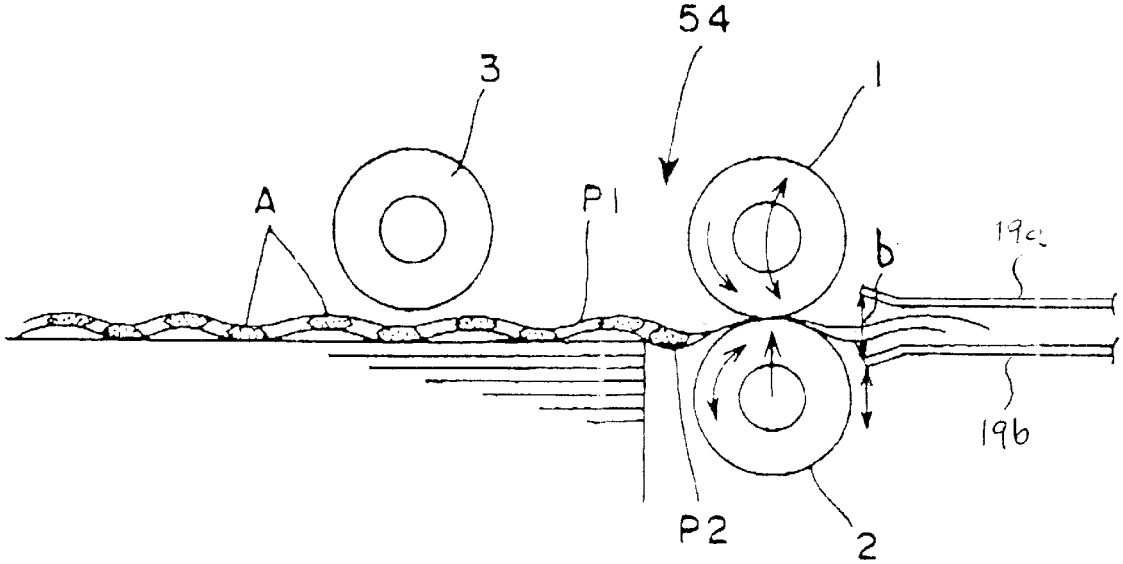
FIG. 7 is a view showing another specific condition wherein the paper feeder loosens paper sheets.

As shown in FIG. 7, an upper guide 19*a* and a lower guide 19*b* may alternatively be arranged on the paper conveyance path downstream of the position where the feed roller 1 and reverse roller 2 are pressed against each other in the direction of paper conveyance. In this configuration, the vibration width of the feed roller 1 is selected to be smaller than a distance b between the paper inlet ends of the guides 19*a* and 19*b*:

$$b \geqq 2 \times x$$

So long as the vibration width of the feed roller 1 is confined in the width of the paper conveyance path, the width over which the nip between the feed roller 1 and the reverse roller 2 may vary due to vibration can be regulated to prevent the paper sheet from hitting against or missing the guides 18*a* and 18*b* or 19*a* and 19*b*. This is also true even when the lower guide 18*a* or 19*b* is present alone.

The vibration of the feed roller 1 and reverse roller 2 will not be necessary for users using paper sheets of the kind free form the simultaneous feed discussed above. In such a case, the eccentric cams 15 and 27 should only be replaced with simple rollers. Therefore, whether or not to cause vibration to occur can be easily selected by replacement, as desired.

Figure 8:
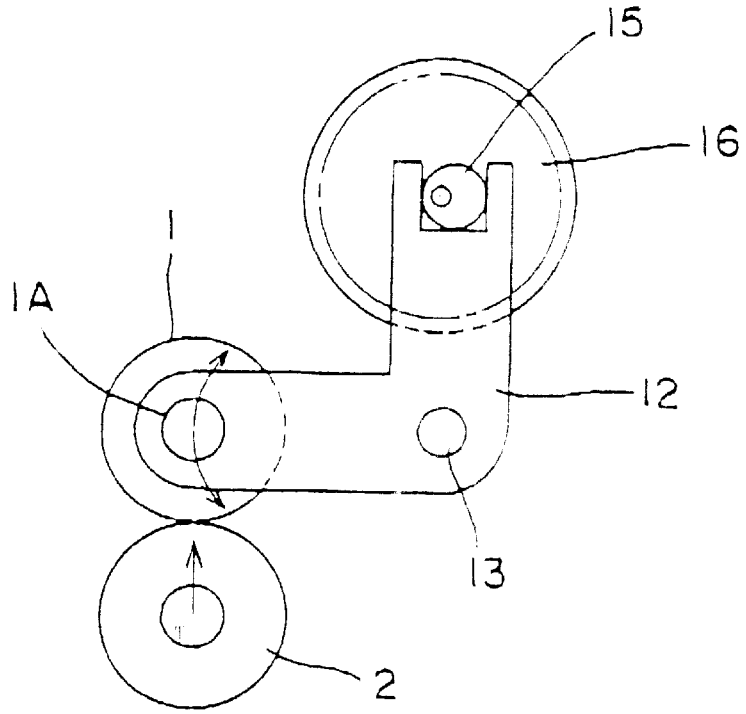
FIGS. 8 and 9 are views each showing still another specific configuration of the vibration generating device.

Reference will be made to FIG. 8 for describing still another specific configuration of the vibration generating device. As shown, only the feed roller 1 is caused to vibrate by the vibration generating device made up of the arm 12, eccentric cam 12, and drive gear 16. The reverse roller 2 is pressed against the feed roller 1 by the pressures F1 and F2 shown in FIG. 2. The feed roller 1 therefore causes the reverse roller 2 to vibrate when it is caused to vibrate. This configuration achieves the previously stated advantages without resorting to an exclusive vibration mechanism for the reverse roller 2. In addition, such a vibration generating device needs a minimum number of parts and therefore reduces the cost of the apparatus.

Figure 9:
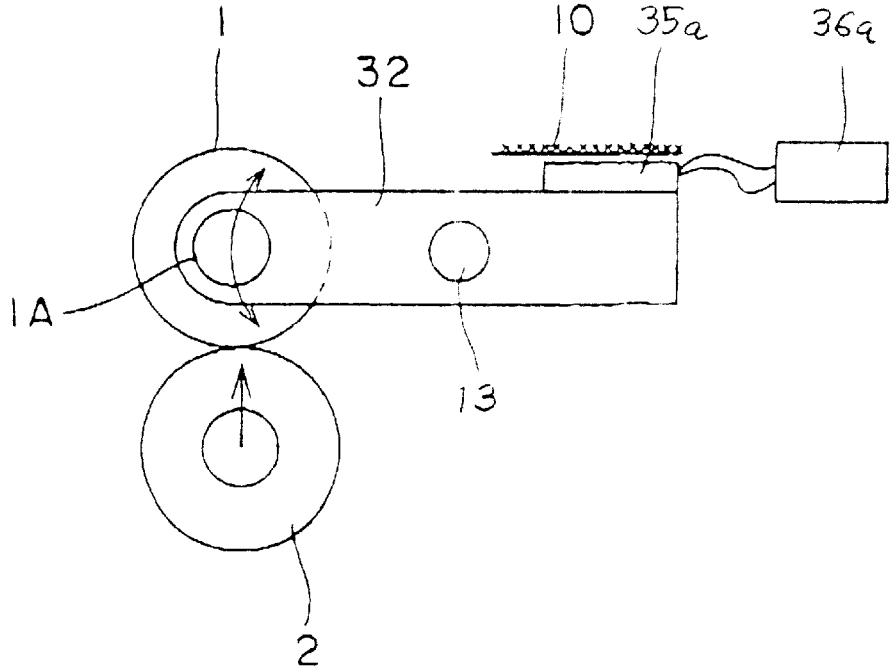

FIG. 9 shows a further specific configuration of the vibration generating device. This configuration causes the feed roller 1 to vibrate without using the mechanical arrangement including the drive gear 15 and eccentric cam 15. As shown, an arm 32 angularly movable about a shaft 13 supports the feed roller 1 at one end thereof and supports the piezoelectric device 35*a* at the other end thereof. The frame 10 adjoins the piezoelectric device 35*a*. The variable voltage source 36*a* is connected to the piezoelectric device 35*a* for applying a variable voltage to the device 35*a*. This arrangement also successfully causes the feed roller 1 to vibrate while causing the reverse roller 2 to vibrate.

Figure 10:
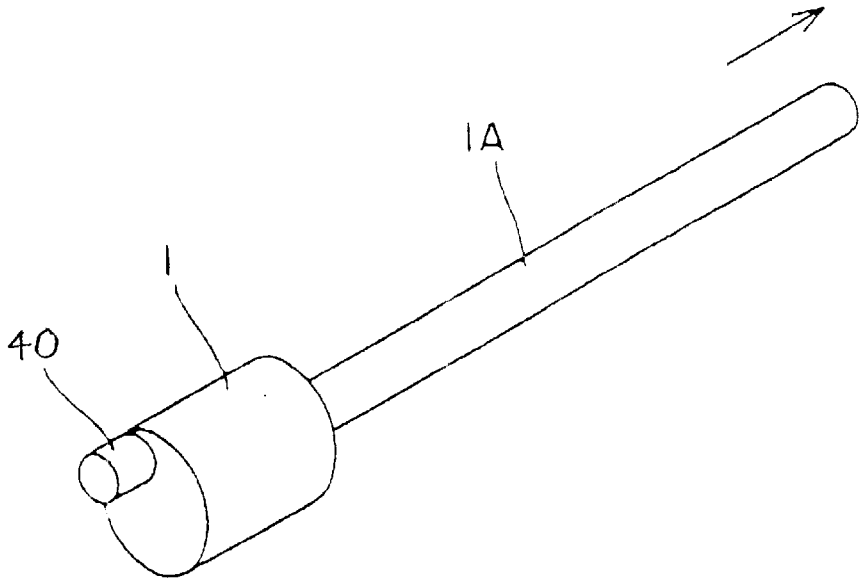
FIGS. 10, 11 and 12 are isometric views each showing a specific modified configuration of the feed roller.

A modified form of the feed roller 1 is shown in FIG. 10. As shown, a weight 40 is mounted on one end face of the feed roller 1 in order to provide the feed roller 1 itself with eccentricity. More specifically, the weight 40 shifts the center of gravity of the cantilevered feed roller 1 from the axis of the roller 1. As a result the feed roller 1 automatically vibrates when in rotation. The weight 40 may be replaced with a non-uniform cross-section of the feed roller 1, if desired.

The paper feeder including the feed roller 1 shown in FIG. 10 causes the roller 1 to automatically vibrate even in the direction in which the reverse roller 2 is pressed against the roller 1. As a result, even if two or more paper sheets are brought into the nip between the feed roller 1 and the reverse roller 2, air is introduced between the paper sheets. This air reduces the adhering force acting between the paper sheets and thereby prevents the paper sheets from being fed together. Moreover, the feed roller 1 automatically vibrates because of its eccentricity and therefore does not need an extra mechanism that would increase the cost of the apparatus. It is to be noted that the vibration of the feed roller 1 does not obstruct drive transmission at all because the roller 1 is rotated via a belt.

Figure 11:
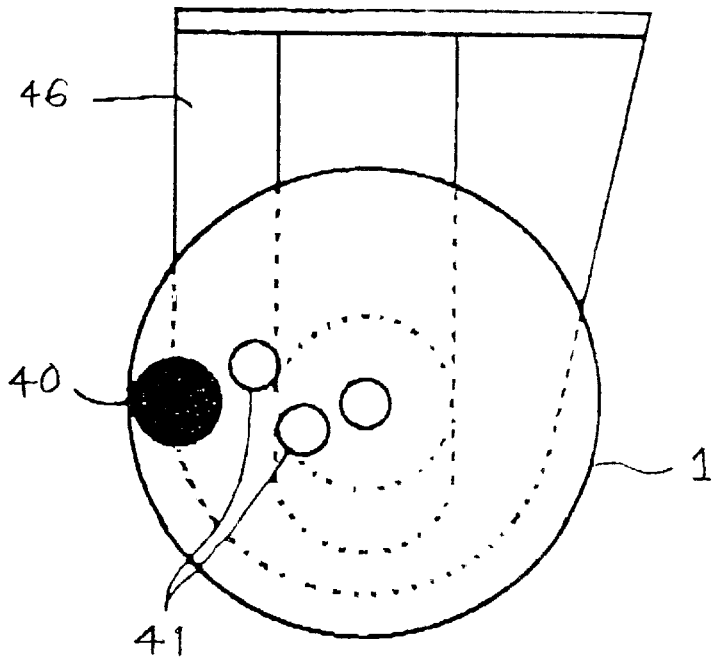

A plurality of weights 40 each having a particular weight may be prepared and selectively removably mounted to the feed roller 1 in order to adjust the vibration width. Alternatively, as shown in FIG. 11, the feed roller 1 may be formed with a plurality of threaded holes 41 at different positions in the radial direction thereof, in which case a single threaded weight 40 will be driven into any one of the holes 41 for adjusting the vibration width. In FIG. 11, the reference numeral 46 designates a support plate.

Figure 12:
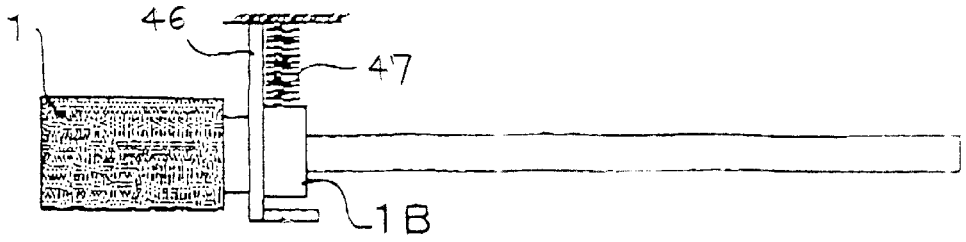
Figure 13:
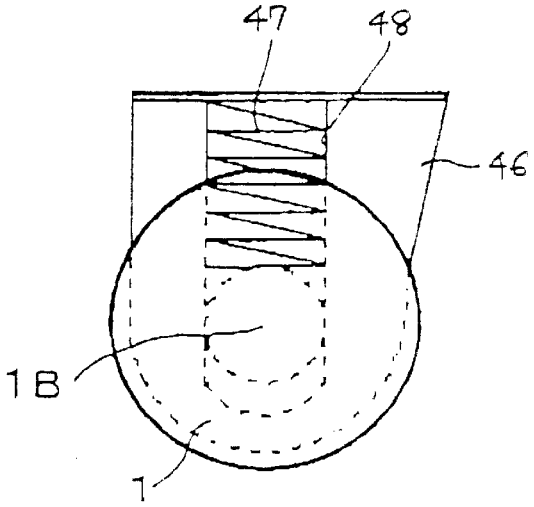
FIG. 13 is a side elevation of the feed roller shown in FIG. 12.
Figure 14:
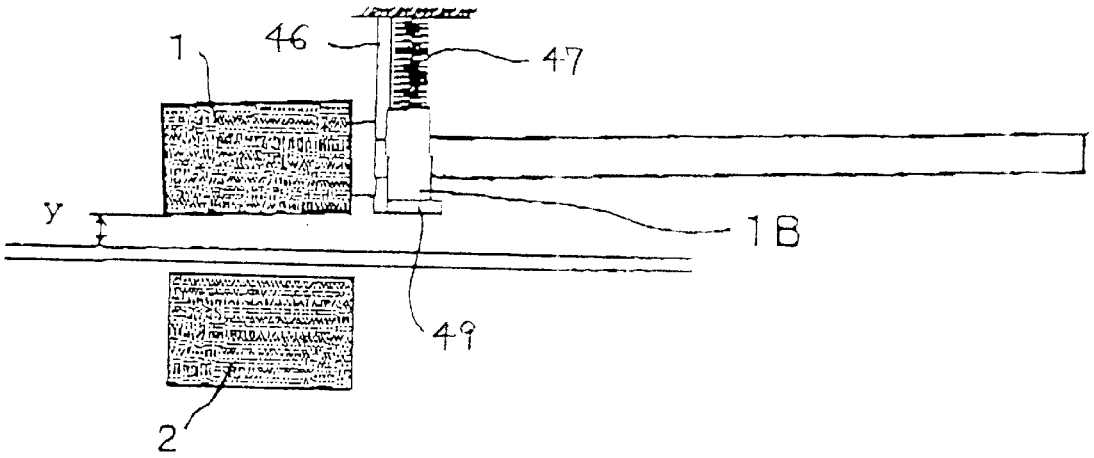
FIG. 14 is a front view showing a condition wherein the reverse roller is removed away from the feed roller.

To reduce adhesion between the paper sheets, the feed roller 1 should preferably vibrate only in the direction in which it is pressed against the reverse roller 2; vibration in the other directions might cause the paper sheet to skew or bend or even jam the path. In light of this, as shown in FIGS. 12 and 13, the support plate 46 is formed with a guide slot 48 coincident in direction with a line connecting the axis of the feed roller 1 and that of the reverse roller 2. The shaft 1A of the feed roller 1 is received in the guide slot 48 via a bearing 1B, so that the feed roller 1 can vibrate only in the direction in which the guide slot 48 extends. Further, a spring or biasing means 47 presses the feed roller 1 with a resilient force equal in intensity, but opposite in direction to, the pressing force of the reverse roller 2. In this condition, while the feed roller 1 is in rotation, the center of the amplitude of rotation can be maintained at the nip between the roller 1 and the reverse roller 2. It follows that the vibration of the feed roller 1 is prevented from causing the paper sheet to skew, fold or jam the path. When When the reverse roller 2 is dismounted from the apparatus body for one reason or another, the feed roller 1 must be prevented from excessively turning toward the position assigned to the reverse roller 2. For this purpose, as shown in FIG. 14, a stop 49 is provided on the support plate 46. The stop 49 stops the bearing 1B to thereby restrict the angular displacement of the feed roller 1.

While the foregoing description has concentrated on the roller type paper feeder, the paper feeder of the present invention may alternatively use a friction pad. In a paper feeder using a friction pad, the friction pad will be supported in such a manner as to be movable into contact with the feed roller 1 and be caused to vibrate by the roller 1.

There is a fear that the vibration of the feed roller 1 disturbs the rotation of the roller 1 itself. Experiments, however, showed that the vibration of the feed roller 1 was scarcely transferred to gears and did not bring about any problem in the aspect of practical use.

In summary, it will be seen that the present invention provides a paper feeder and an image forming apparatus including it that have various unprecedented advantages, as enumerated below.

(1) A feed roller and a separating member vibrate in synchronism with each other and can therefore vibrate with large amplitude. It follows that the feed roller and separating member surely loosen paper sheets closely adhering to each other by applying vibration thereto.

(2) Despite the enhanced separating ability of the feed roller and separator roller derived from the synchronous vibration, the vibration does not cause a paper sheet to, e.g. , miss a preselected path or obliquely hit against the path and bend.

(3) A single drive gear can cause both of the feed roller and separating member to vibrate with the same amplitude at the same period.

(4) The feed roller in vibration causes the separating member pressed against the roller to vibrate. The advantage (1) is therefore achievable at low cost.

(5) The feed roller and separating member can vibrate with the same amplitude at the same period while obviating the need for an exclusive vibration generating device for the separating member.

(6) The rotation of the feed roller can be used to cause the roller to vibrate in the direction in which the roller and separating member are pressed against each other.

(7) When the separating member is implemented as a reverse roller, the rotation of the reverse roller can be used to cause the reverse roller to vibrate in the direction in which the two rollers are pressed against each other.

(8) A desired size of vibration of the feed roller or that of the reverse roller is selectable with a simple configuration, (9) The center of vibration of the feed roller can be maintained at the nip between the feed roller and the reverse roller.

(10) The vibration of the feed roller or that of the reverse roller does not adversely effect drive transmission.

(11) A friction pad type separation system further enhances the paper separating ability of the paper feeder.

Various modifications will become possible for those skilled in the art after receiving the teachings of the present disclosure without departing from the scope thereof.

What is claimed is:

1. A paper feeder for separating paper sheets from each other while conveying said paper sheets, comprising:

a rotatable feed roller;

separating means pressed against said feed roller, wherein the paper sheets are nipped between said feed roller and said separating means; and vibration generating means for applying vibration to said feed roller;

wherein said feed roller causes said separating means to vibrate when caused to vibrate by said vibration generating means, and wherein said vibration generating means comprises support means for angularly movably supporting said feed roller and a vibration generating device.

2. A paper feeder for separating paper sheets from each other while conveying said papers sheets, comprising:

a rotatable feed roller;

separating means pressed against said feed roller, wherein the paper sheets are nipped between said feed roller and said separating means; and vibration generating means for applying vibration to said feed roller;

wherein said feed roller causes said separating means to vibrate when caused to vibrate by said vibration generating means, and wherein said vibration generating means causes the paper sheets to vibrate in a direction substantially perpendicular to a direction of paper conveyance, and wherein vibrations generated by said vibration generating means have a size confined in a width of a paper conveyance path.

3. A paper feeder as claimed in claim 2, wherein said vibration generating means comprises support means for angularly movably supporting said feed roller, said support means comprising an angularly movable portion including a first drive gear that is held in mesh with a second drive gear.

4. A paper feeder as claimed in claim 3, wherein said feed roller comprises a displaceable member and is configured to be eccentric and is cantilevered.

5. A paper feeder as claimed in claim 4, wherein eccentricity of said feed roller is implemented by a weight removably mounted to said feed roller.

6. A paper feeder as claimed in claim 5, wherein said weight is removably mounted to any one of a plurality of positions of said feed roller.

7. A paper feeder as claimed in claim 6, wherein drive transmission to said displaceable member is implemented by belt means for driving.

8. A paper feeder as claimed in claim 2, wherein the paper transfer path is formed by a pair of guides located in a range in which said feed roller and said separating means are pressed against each other.

9. A paper feeder as claimed in claim 2, wherein the paper transfer path is formed by a pair of guides located downstream, in the direction of paper conveyance, of a range in which said feed roller and said separating means are pressed against each other.

10. A paper feeder for separating paper sheets from each other while conveying said paper sheets, comprising:

a rotatable feed roller;

separating means pressed against said feed roller, wherein the paper sheets are nipped between said feed roller and said separating means; and vibration generating means for applying vibration to said feed roller;

wherein said feed roller causes said separating means to vibrate when caused to vibrate by said vibration generating means, and wherein said vibration generating means comprises support means for angularly movably supporting said feed roller, said support means comprising an angularly movable portion including a first drive gear that is held in mesh with a second drive gear.

11. A paper feeder as claimed in claim 10, wherein said feed roller comprises a displaceable member and is configured to be eccentric and is cantilevered.

12. A paper feeder as claimed in claim 11, wherein eccentricity of said feed roller is implemented by a weight removably mounted to said feed roller.

13. A paper feeder as claimed in claim 12, wherein said weight is removably mounted to any one of a plurality of positions of said feed roller.

14. A paper feeder as claimed in claim 13, wherein drive transmission to said displaceable member is implemented by belt means for driving.

15. A paper feeder as claimed in claim 1, wherein said feed roller comprises a displaceable member and is configured to be eccentric and is cantilevered.

16. A paper feeder as claimed in claim 15, wherein eccentricity of said feed roller is implemented by a weight removably mounted to said feed roller.

17. A paper feeder as claimed in claim 16, wherein said weight is removably mounted to any one of a plurality of positions of said feed roller.

18. A paper feeder as claimed in claim 17, wherein drive transmission to said displaceable member is implemented by belt means for driving.

19. A paper feeder for separating paper sheets from each other while conveying said paper sheets, comprising:

a rotatable feed roller;

separating means pressed against said feed roller, wherein the paper sheets are nipped between said feed roller and said separating means; and vibration generating means for applying vibration to said feed roller;

wherein said feed roller causes said separating means to vibrate when caused to vibrate by said vibration generating means, and wherein said feed roller comprises a displaceable member and is configured to be eccentric and is cantilevered.

20. A paper feeder as claimed in claim 19, wherein eccentricity of said feed roller is implemented by a weight removably mounted to said feed roller.

21. A paper feeder as claimed in claim 20, wherein said weight is removably mounted to any one of a plurality of positions of said feed roller.

22. A paper feeder as claimed in claim 21, wherein drive transmission to said displaceable member is implemented by belt means for driving.

23. A paper feeder as claimed in claim 19, wherein eccentricity of said feed roller is implemented by a cross-section of said feed roller in which a weight distribution is not uniform.

24. A paper feeder as claimed in claim 19, wherein said feed roller is supported by a resilient member counteracting a pressure acting on said feed roller with a same size as said pressure.

25. A paper feeder as claimed in claim 19, wherein drive transmission to said displaceable member is implemented by belt means for driving.

26. A paper feeder for separating paper sheets from each other while conveying said paper sheets, comprising:

a rotatable feed roller;

separating means pressed against said feed roller, wherein the paper sheets are nipped between said feed roller and said separating means; and vibration generating means for applying vibration to said feed roller;

wherein said feed roller causes said separating means to vibrate when caused to vibrate by said vibration generating means, and wherein said separating means comprises a displaceable reverse roller that is eccentric and cantilevered.

27. A paper feeder as claimed in claim 26, wherein eccentricity of said feed roller is implemented by a weight removably mounted to said feed roller.

28. A paper feeder as claimed in claim 27, wherein said weight is removably mounted to any one of a plurality of positions of said feed roller.

29. A paper feeder as claimed in claim 28, wherein drive transmission to said displaceable member is implemented by a belt.

30. A paper feeder as claimed in claim 1, wherein said separating means comprises a reverse roller with which a torque limiter is associated.

31. An image forming apparatus comprising:

a paper feeder comprising a feed roller driven to rotate and separating means pressed against said feed roller for separating paper sheets from each other while conveying said paper sheets, wherein the paper sheets are nipped between said feed roller and said separating means; and vibration generating means for applying vibration to said feed roller;

wherein said feed roller causes said separating means to vibrate when caused to vibrate by said vibration generating means, and wherein said vibration generating means causes the paper sheets to vibrate in a direction substantially perpendicular to a direction of paper conveyance, and wherein the vibrations generated by said vibration generating means have a size confined in a width of a paper conveyance path.

32. A paper feeder for separating paper sheets from each other while conveying said paper sheets, comprising:

a rotatable feed roller;

a separating member configured to be pressed against said feed roller, wherein the paper sheets are nipped between said feed roller and said separating member; and a vibration generating device constructed to apply vibration to said feed roller;

wherein said feed roller causes said separating member to vibrate when caused to vibrate by said vibration generating device, and wherein said vibration generating device causes the paper sheets to vibrate in a direction substantially perpendicular to a direction of paper conveyance, and wherein the vibrations generated by said vibration generating device have a size confined in a width of a paper conveyance path.

33. A paper feeder as claimed in claim 32, wherein said vibration generating device comprises a support member angularly movably supporting said feed roller, said support member comprising an angularly movable portion including a first drive gear that is held in mesh with a second drive gear.

34. A paper feeder as claimed in claim 33, wherein said feed roller comprises a displaceable member and is configured to be eccentric and is cantilevered.

35. A paper feeder as claimed in claim 34, wherein eccentricity of said feed roller is implemented by a weight removably mounted to said feed roller.

36. A paper feeder as claimed in claim 35, wherein said weight is removably mounted to any one of a plurality of positions of said feed roller.

37. A paper feeder as claimed in claim 36, wherein drive transmission to said displaceable member is implemented by a belt.

38. A paper feeder as claimed in claim 32, wherein the paper transfer path is formed by a pair of guides located in a range in which said feed roller and said separating member are pressed against each other.

39. A paper feeder as claimed in claim 32, wherein the paper transfer path is formed by a pair of guides located downstream, in the direction of paper conveyance, of a range in which said feed roller and said separating member are pressed against each other.

40. A paper feeder for separating paper sheets from each other while conveying said paper sheets, comprising:

a rotatable feed roller;

a separating member configured to be pressed against said feed roller, wherein the paper sheets are nipped between said feed roller and said separating member; and a vibration generating device constructed to apply vibration to said feed roller;

wherein said feed roller causes said separating member to vibrate when caused to vibrate by said vibration generating device, and wherein said vibration generating device comprises a support member angularly movably supporting said feed roller, said support member comprising an angularly movable portion including a drive gear that is held in mesh with a second drive gear.

41. A paper feeder as claimed in claim 40, wherein said feed roller comprises a displaceable member and is configured to be eccentric and is cantilevered.

42. A paper feeder as claimed in claim 41, wherein eccentricity of said feed roller is implemented by a weight removably mounted to said feed roller.

43. A paper feeder as claimed in claim 42, wherein said weight is removably mounted to any one of a plurality of positions of said feed roller.

44. A paper feeder as claimed in claim 43, wherein drive transmission to said displaceable member is implemented by a belt.

45. A paper feeder for separating paper sheets from each other while conveying said paper sheets, comprising:

a rotatable feed roller;

a separating member configured to be pressed against said feed roller, wherein the paper sheets are nipped between said feed roller and said separating member; and a vibration generating device constructed to apply vibration to said feed roller;

wherein said feed roller causes said separating member to vibrate when caused to vibrate by said vibration generating device, and wherein said vibration generating device comprises a support member configured to angularly movably support the feed roller and caused to vibrate by a vibration generating element.

46. A paper feeder as claimed in claim 45, wherein said feed roller comprises a displaceable member and is configured to be eccentric and is cantilevered.

47. A paper feeder as claimed in claim 46, wherein eccentricity of said feed roller is implemented by a weight removably mounted to said feed roller.

48. A paper feeder as claimed in claim 47, wherein said weight is removably mounted to any one of a plurality of positions of said feed roller.

49. A paper feeder as claimed in claim 48, wherein drive transmission to said displaceable member is implemented by belt means for driving.

50. A paper feeder for separating paper sheets from each other while conveying said paper sheets, comprising:

a rotatable feed roller;

a separating member configured to be pressed against said feed roller, wherein the paper sheets are nipped between said feed roller and said separating member; and a vibration generating device constructed to apply vibration to said feed roller;

wherein said feed roller causes said separating member to vibrate when caused to vibrate by said vibration generating device, and wherein said feed roller comprises a displaceable member and is configured to be eccentric and is cantilevered.

51. A paper feeder as claimed in claim 50, wherein eccentricity of said feed roller is implemented by a weight removably mounted to said feed roller.

52. A paper feeder as claimed in claim 51, wherein said weight is removably mounted to any one of a plurality of positions of said feed roller.

53. A paper feeder as claimed in claim 52, wherein drive transmission to said displaceable member is implemented by a belt.

54. A paper feeder as claimed in claim 50, wherein eccentricity of said feed roller is implemented by a cross-section of said feed roller in which a weight distribution is not uniform.

55. A paper feeder as claimed in claim 50, wherein said feed roller is supported by a resilient member configured to counteract a pressure acting on said feed roller with a same size as said pressure.

56. A paper feeder as claimed in claim 50, wherein drive transmission to said displaceable member is implemented by a belt.

57. A paper feeder for separating paper sheets from each other while conveying said paper sheets, comprising:

a rotatable feed roller;

separating means configured to be pressed against said feed roller, wherein the paper sheets are nipped between said feed roller and said separating member; and a vibration generating device constructed to apply vibration to said feed roller;

wherein said feed roller causes said separating means to vibrate when caused to vibrate by said vibration generating device, and wherein said separating means comprises a displaceable reverse roller that is eccentric and cantilevered.

58. A paper feeder as claimed in claim 57, wherein eccentricity of said feed roller is implemented by a weight removably mounted to said feed roller.

59. A paper feeder as claimed in claim 58, wherein said weight is removably mounted to any one of a plurality of positions of said feed roller.

60. A paper feeder as claimed in claim 59, wherein drive transmission to said displaceable member is implemented by a belt.

61. A paper feeder as claimed in claim 60, wherein said separating means comprises a reverse roller with which a torque limiter is associated.

62. An image forming apparatus comprising:

a paper feeder comprising a feed roller driven to rotate and a separating member pressed against said feed roller and constructed to separate paper sheets from each other while conveying said paper sheets, wherein the paper sheets are nipped between said feed roller and said separating member; and a vibration generating device for applying vibration to said feed roller;

wherein said feed roller causes said separating member to vibrate when caused to vibrate by said vibration generating device, and wherein said vibration generating device causes the paper sheets to vibrate in a direction substantially perpendicular to a direction of paper conveyance, and wherein the vibrations generated by said vibration generating device have a size confined in a width of a paper conveyance path.

* * * * *